US012422165B2

(12) United States Patent
Chan et al.

(10) Patent No.: US 12,422,165 B2
(45) Date of Patent: Sep. 23, 2025

(54) CONDENSATE EVAPORATION DEVICE FOR AIR CONDITIONING APPARATUS

(71) Applicant: DELTA ELECTRONICS, INC., Taoyuan (TW)

(72) Inventors: Chao-Hsien Chan, Taoyuan (TW); Yi-Chung Chou, Taoyuan (TW); Chun-Hsun Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 261 days.

(21) Appl. No.: 18/098,125

(22) Filed: Jan. 18, 2023

(65) Prior Publication Data

US 2024/0068705 A1 Feb. 29, 2024

(30) Foreign Application Priority Data

Aug. 24, 2022 (CN) ..... 202222237093.2

(51) Int. Cl.
*F24F 13/30* (2006.01)
*F24F 13/22* (2006.01)

(52) U.S. Cl.
CPC ..... *F24F 13/222* (2013.01); *F24F 2013/225* (2013.01)

(58) Field of Classification Search
CPC ..... F24F 2013/225; F24F 2013/227; F24F 13/30; F24F 13/222; F24F 13/22
See application file for complete search history.

(56) References Cited

U.S. PATENT DOCUMENTS 1,986,863 A * 1/1935 Terry ..... F24F 3/1405 62/289
2,105,108 A * 1/1938 Crosley, Jr. ..... A47C 21/044 62/331
2,549,547 A * 4/1951 Trask ..... F24F 3/1405 62/274
2,970,457 A * 2/1961 MacLeod ..... F24F 1/029 62/262
4,229,847 A * 10/1980 Degen ..... A47C 27/15 5/724

(Continued)

FOREIGN PATENT DOCUMENTS

CN 215951584 U 3/2022
TW 224737 B 6/1994

*Primary Examiner* — Filip Zec
(74) *Attorney, Agent, or Firm* — HDLS IPR SERVICES; Chun-Ming Shih

(57) ABSTRACT

This disclosure is a condensate evaporation device. An air conditioning apparatus includes a compressor, an evaporator and a condenser connected with one another. A water tray is arranged to receive the condensate. A water distribution module includes a water separator base and a water separator piece. The water separator piece and the water separator base are combined to define a water channel. The condensate flows through the water channel to evenly flow out. A multi-folded water absorbing body is arranged on one side of the water separator base to absorb the condensate flowed out from the water separator base. The water tank is arranged on a bottom side of the multi-folded water absorbing body. A fan is arranged on one side of the multi-folded water absorbing body. Accordingly, the condensate may be evaporated efficiently.

8 Claims, 12 Drawing Sheets

(56) References Cited

U.S. PATENT DOCUMENTS

| | | | | | |
|---|---|---|---|---|---|
| 5,966,958 | A * | 10/1999 | Maynard | F25D 21/14 | 62/277 |
| 5,992,171 | A * | 11/1999 | Bacchus | F25B 39/04 | 62/305 |
| 6,065,299 | A * | 5/2000 | Chen | F25D 21/14 | 62/277 |
| 6,345,514 | B1 * | 2/2002 | Moon | F24F 13/222 | 62/277 |
| 6,640,574 | B2 * | 11/2003 | Lee | F24F 13/222 | 62/305 |
| 7,150,161 | B2 * | 12/2006 | Huang | F24F 13/222 | 62/305 |
| 7,263,852 | B2 * | 9/2007 | Bacchus | F25B 39/04 | 62/305 |
| 7,673,468 | B2 * | 3/2010 | Bhatti | F28F 13/003 | 62/316 |
| 9,151,507 | B2 * | 10/2015 | Kil | F24F 1/0323 | |
| 9,776,474 | B2 * | 10/2017 | Kume | F24F 13/222 | |
| 11,231,212 | B2 * | 1/2022 | Snider | F28D 7/106 | |
| 2002/0029578 | A1 | 3/2002 | Moon et al. | | |
| 2007/0209373 | A1 * | 9/2007 | Taira | F24F 1/0063 | 62/78 |
| 2009/0071181 | A1 * | 3/2009 | Spanger | F24F 13/222 | 62/262 |
| 2014/0331698 | A1 * | 11/2014 | Daley | F24F 13/224 | 62/291 |

* cited by examiner

CONDENSATE EVAPORATION DEVICE FOR AIR CONDITIONING APPARATUS

BACKGROUND OF THE DISCLOSURE

Technical Field

The disclosure relates to an air conditioning apparatus, and more particularly relates to a condensate evaporation device for an air conditioning apparatus.

Description of Related Art

An air conditioning apparatus is used to adjust the temperature, humidity, and air cleanliness in an area to change the ambient temperature or humidity. When using the air conditioning apparatus, the evaporator produces condensate due to the heat exchange. Moreover, a related art of air conditioning apparatus discharges the condensate to pipelines or outside through a conduit, or the condensate is collected in the water tray and heated by electric heating elements to be vaporized. Additionally, the condensate may be absorbed in sponges and evaporated through the air flow from the fan.

However, in the above methods of treating the condensate, heating circuit is required when the condensate is heated and vaporized by electric heating elements. That may increase power consumption and have a risk of overheating, so that the protection circuit is needed additionally. Furthermore, when more condensate is generated, the condensate absorbed in the sponges may not be evaporated in time, and that may result in the overflow of condensate.

In view of the above drawbacks, the inventor proposes this disclosure based on his expert knowledge and elaborate researches in order to solve the problems of related art.

SUMMARY OF THE DISCLOSURE

One object of this disclosure is to provide a condensate evaporation device for the air conditioning apparatus, which the condensate is evaporated by the arrangement of the water distribution module and the multi-folded water absorbing body.

Another object of this disclosure is to provide a condensate evaporation device for the air conditioning apparatus to improve evaporation efficiency and achieve the effects of simplify structure and reduce energy consumption.

This disclosure is a condensate evaporation device. An air conditioning apparatus includes a compressor, an evaporator and a condenser connected to one another. A water tray is arranged on one side of the evaporator to receive a condensate condensed from the evaporator. A water distribution module includes a water separator base and a water separator piece. The water separator piece is combined in the water separator base and has a water channel. The condensate enters the water separator piece and flows through the water channel to evenly flow out the water separator base. The multi-folded water absorbing body is arranged on one side of the water separator base to absorb the condensate flowed out from the water separator base. The water tank is arranged on a bottom side of the multi-folded water absorbing body to receive the condensate flowed out from the multi-folded water absorbing body. At least one fan is arranged on one side of the multi-folded water absorbing body. The condenser is located between the at least one fan and the multi-folded water absorbing body.

In comparison with the related art, the condensate evaporation device for the air conditioning apparatus in this disclosure includes the water distribution module and the multi-folded water absorbing body. The condensate evenly flows into the multi-folded water absorbing body through the water distribution module. Additionally, the multi-folded absorbing body is folded repeatedly with the same area to form multi layers of connected water absorbing sheets that are stacked on one side of the water distribution module. Therefore, the condensate enters the water distribution module from the condensate pipe and evenly flows into the multi-folded water absorbing body through the water distribution module. The condensate absorbed in the multi-folded water absorbing body may be evaporated rapidly under the blowing of the airflow from the fan. Additionally, the condensate, that is not evaporated in time, may flow out from the multi-folded water absorbing body and be collected, and then be vaporized by the heating of the heat pipe. Therefore, the evaporation efficiency is improved, and the effects of simplifying the structure and reducing energy consumption are achieved to increase the practicability of this disclosure.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
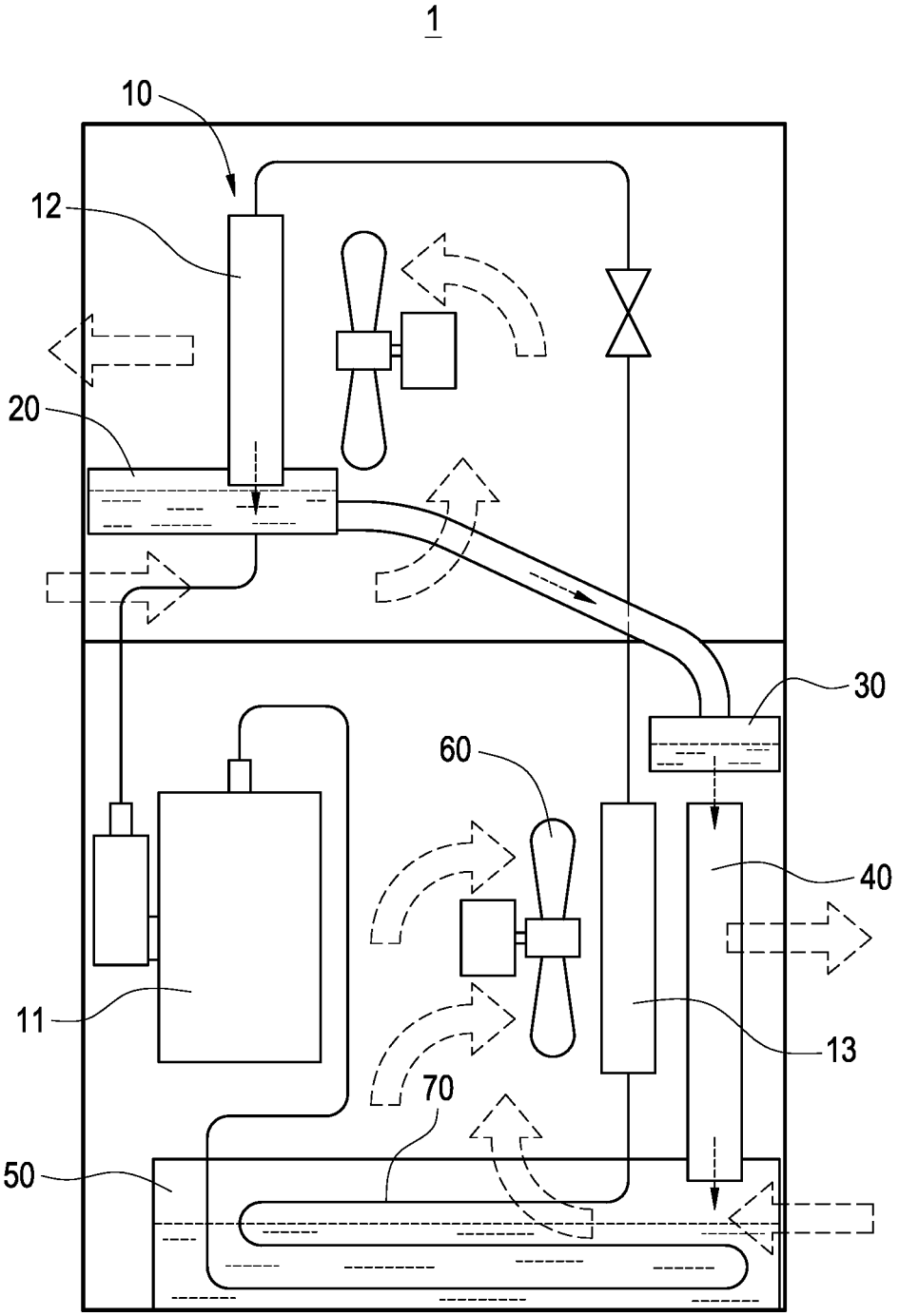
FIG. 1 is a schematic view of the condensate evaporation device for the air conditioning apparatus in this disclosure.
Figure 2:
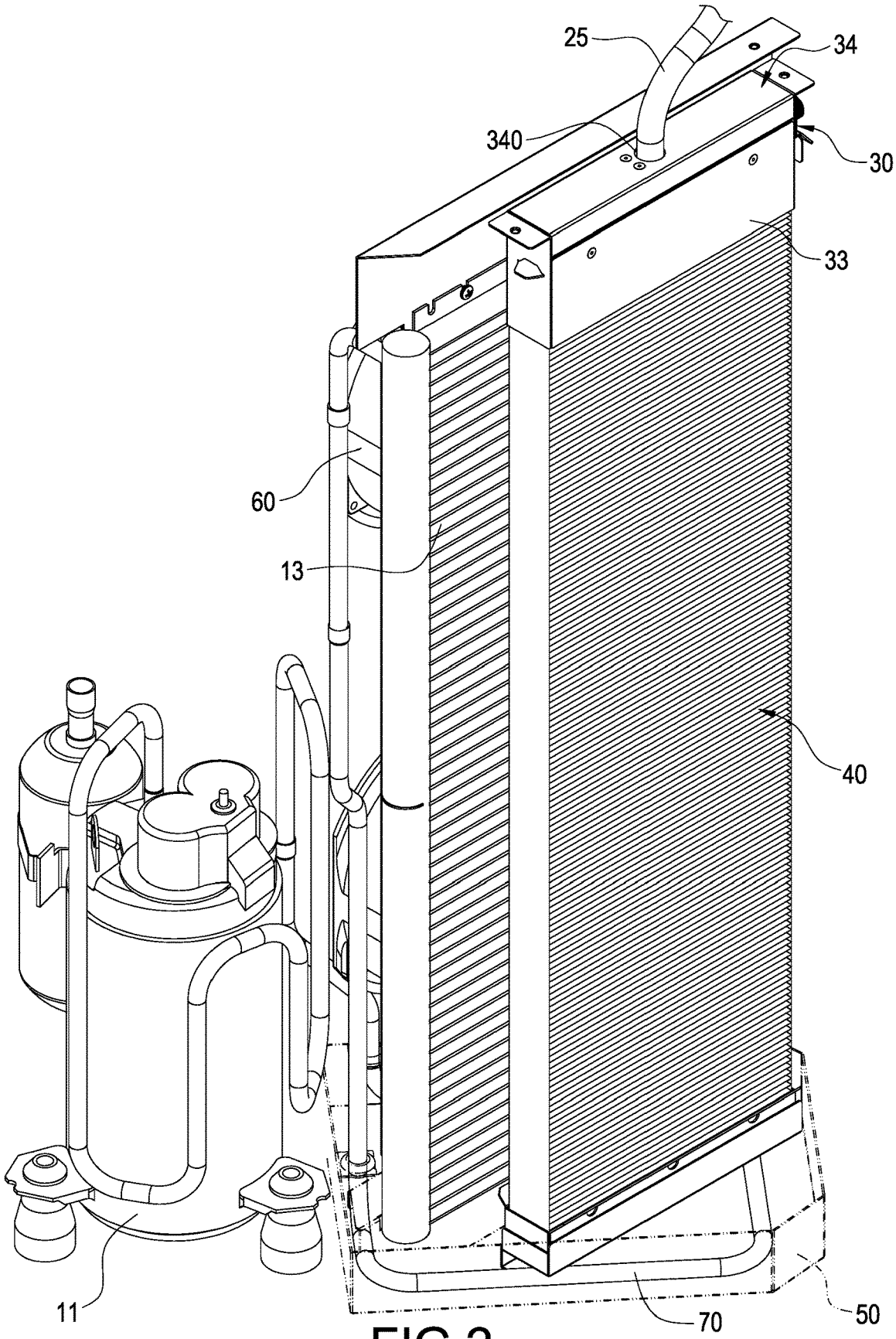
FIG. 2 is a perspective schematic view of the water distribution module and the multi-folded water absorbing body in this disclosure.
Figure 3:
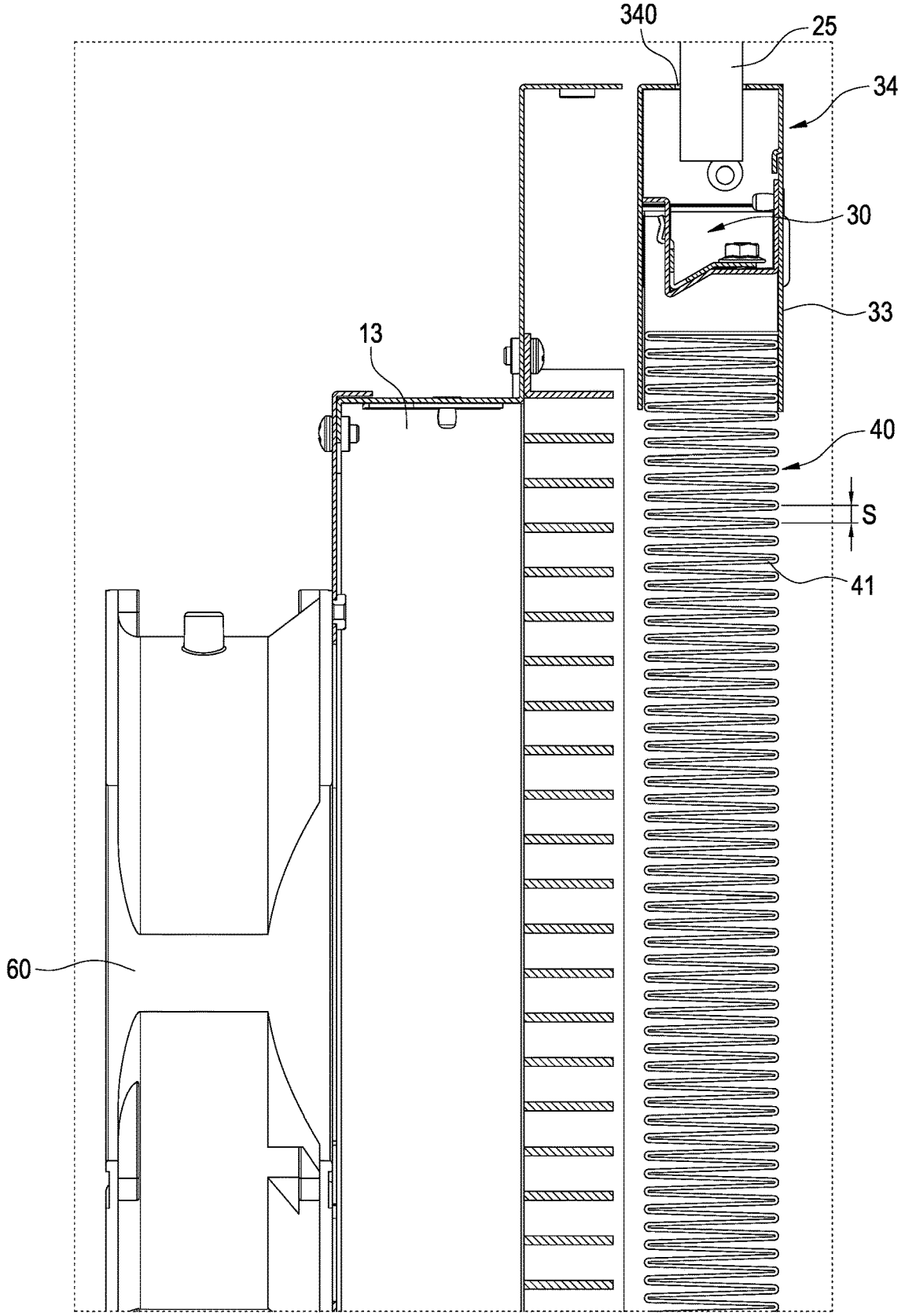
FIG. 3 is a cross-sectional view of the upper half of the assembly of the water distribution module and the multi-folded water absorbing body in this disclosure.
Figure 4:
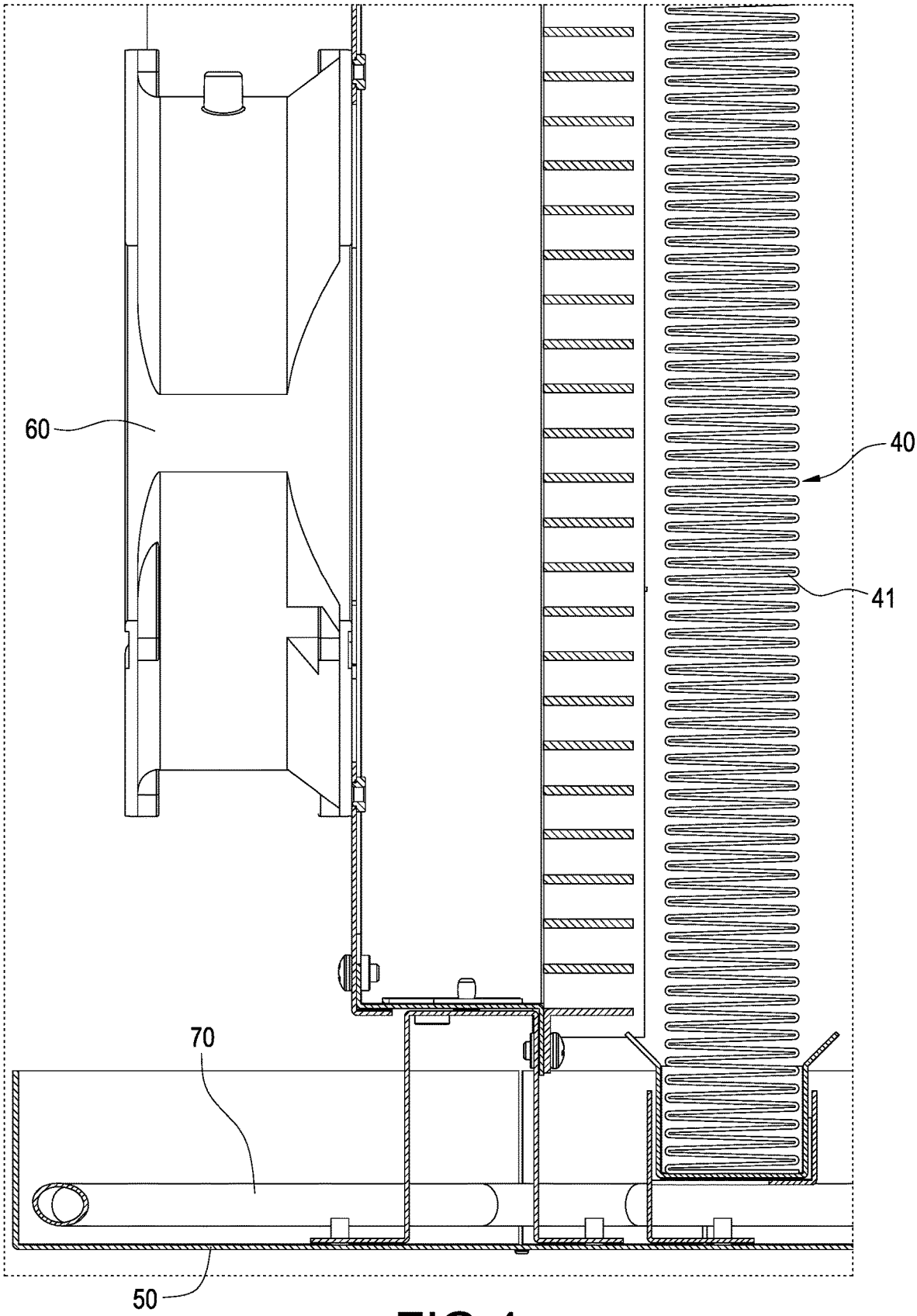
FIG. 4 is a cross-sectional view of the lower half of the assembly of the water distribution module and the multi-folded water absorbing body in this disclosure.
Figure 5:
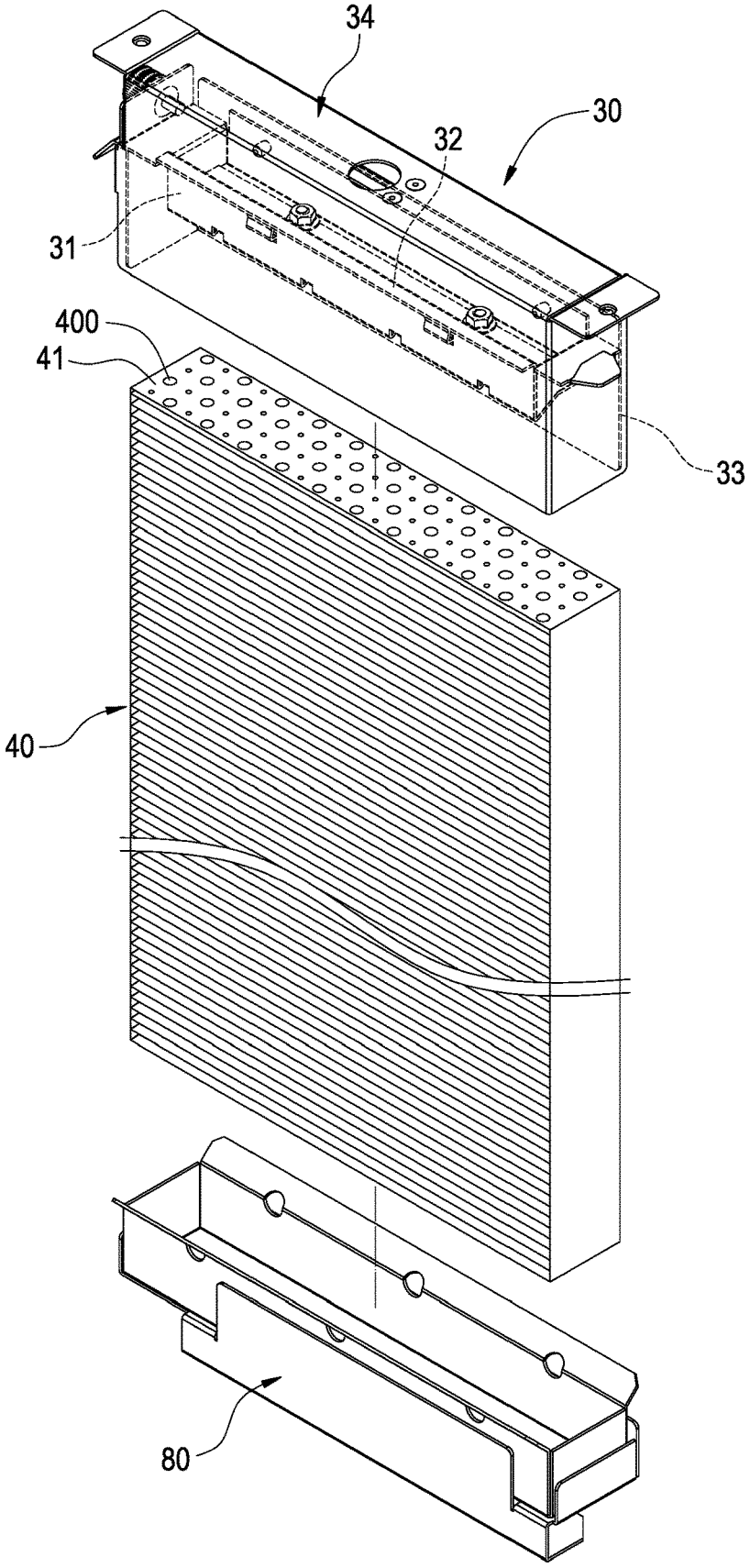
FIG. 5 is a perspective exploded view of the water distribution module and the multi-folded water absorbing body in this disclosure.

Please refer to FIG. 1, which is a perspective schematic view of the condensate evaporation device for the air conditioning apparatus in this disclosure. This disclosure is a condensate evaporation device 1 including an air conditioning apparatus 10, a water tray 20, a water distribution module 30, a multi-folded water absorbing body 40, a water tank 50, at least one fan 60, and at least one heat pipe 70. The air conditioning apparatus 10 includes a compressor 11, an evaporator 12 and a condenser 13 connected to one another. The water tray 20 is arranged on one side of the evaporator 12 to receive the condensate (for example, condensed water) condensed from the evaporator 12. Moreover, the condensate evenly flows into the multi-folded water absorbing body 40 through the water distribution module 30. The water tank 50 is arranged on the bottom side of the multi-folded water absorbing body 40 to receive the condensate flowed out from the multi-folded water absorbing body 40. Furthermore, the fan 60 is arranged on one side of the multi-folded water absorbing body 40. One end of the heat pipe 70 is connected to the compressor 11 and another end of the heat pipe 70 is connected to the condenser 13, and a portion of the heat pipe 70 is extended into the water tank 50. More detail of the condensate evaporation device 1 is described as follows.

Please also refer to FIG. 2 to FIG. 6, which are a perspective schematic view of the water distribution module and the multi-folded water absorbing body in this disclosure, a cross-sectional view of the upper half of the assembly of the water distribution module and the multi-folded water absorbing body in this disclosure, a cross-sectional view of the lower half of the assembly of the water distribution module and the multi-folded water absorbing body in this disclosure, a perspective exploded view of the water distribution module and the multi-folded water absorbing body in this disclosure, and a top view of the multi-folded water absorbing body in this disclosure. In one embodiment of this disclosure, the condensate evaporation device 1 further includes a condensate pipe 25. One end of the condensate pipe 25 is connected to the water tray 20 and another end of the condensate pipe 25 is connected to the water distribution module 30. The condenser 13 is located between the fan 60 and the multi-folded water absorbing body 40. In this embodiment, a plurality of fans 60 are arranged on one side of the condenser 13.

It should be noted that the multi-folded absorbing body 40 includes multiple layers of water absorbing sheets 41. The multi-folded absorbing body 40 is folded repeatedly with the same area by the water absorbing sheets 41 and stacked on one side of the water distribution module 30. In this embodiment, a pitch S is kept between adjacent water absorbing sheets 41. In some embodiments, the arrangement of the pitch S may be adjusted according to the actual condition to keep the water absorption and evaporation of the multi-folded water absorbing body 40.

In this embodiment, a base 80 is disposed on the bottom side of the multi-folded absorbing body 40. The base 80 receives and supports the multi-folded absorbing body 40.

Accordingly, the condensate enters the water distribution module 30 from the condensate pipe and evenly flows into the multi-folded water absorbing body 40 through the water separation module 30. Additionally, the condensate absorbed in the multi-folded water absorbing body 40 may be evaporated by the airflow of the fans 60.

It is worth of noticing that when more condensate flows into the multi-folded water absorbing body 40, the condensate, that is not evaporated in time, may flow out from the multi-folded water absorbing body 40 to be collected in the water tank 50. Then, the condensate may be heated and vaporized by the heat pipe 70.

Figure 6:
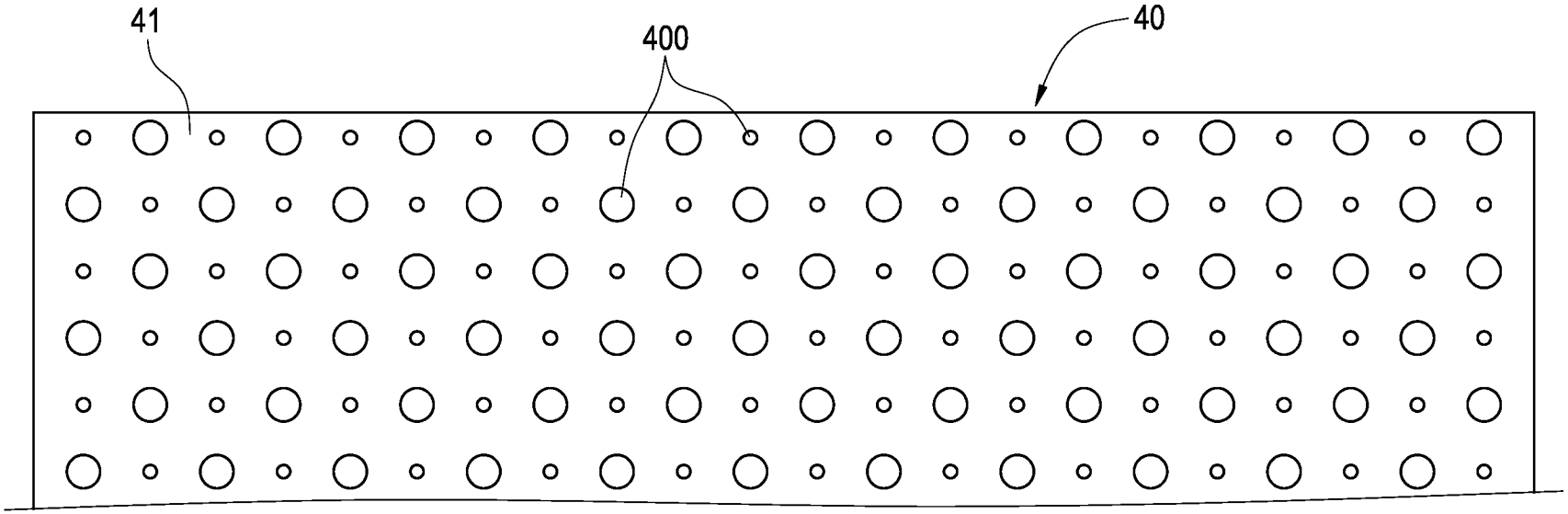
FIG. 6 is a top view of the multi-folded water absorbing body in this disclosure.

Please refer to FIG. 6, a plurality of openings 400 in different sizes are disposed spacedly on the multi-folded water absorbing body 40 in this disclosure. The arrangement of the openings 400 may reduce the resistance of the flowing water and improve the absorption speed of the multi-folded water absorbing body 40. Comparing to the situation of without disposing openings 400, the condensate may infiltrate downward and around faster in the situation of disposing openings 400. Furthermore, the aperture size and spacing of the openings 400 are not restricted, and that may be changed according to actual conditions.

Figure 7:
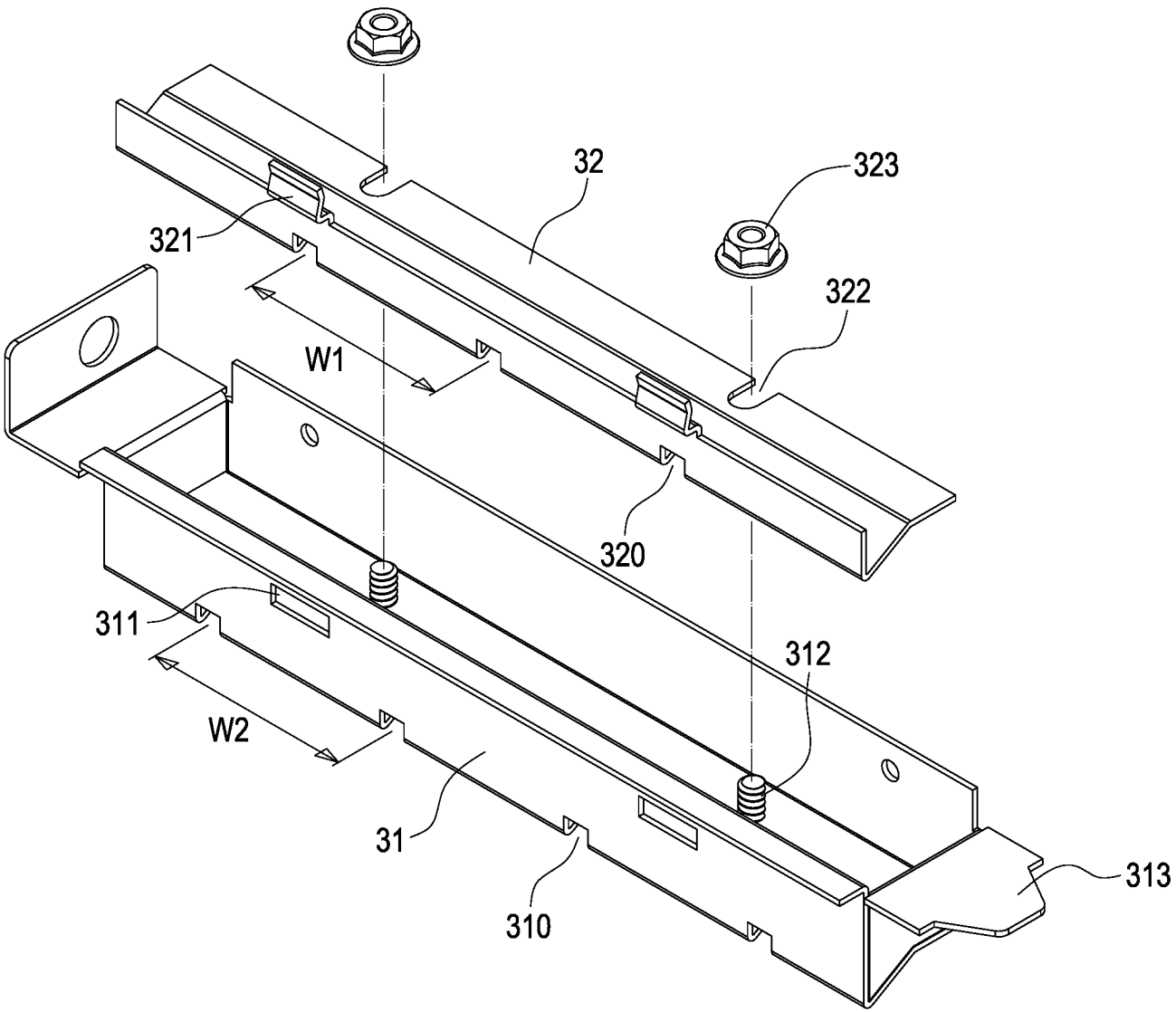
FIG. 7 is a perspective exploded schematic view of the water separator base and the water separator piece in this disclosure.
Figure 8:
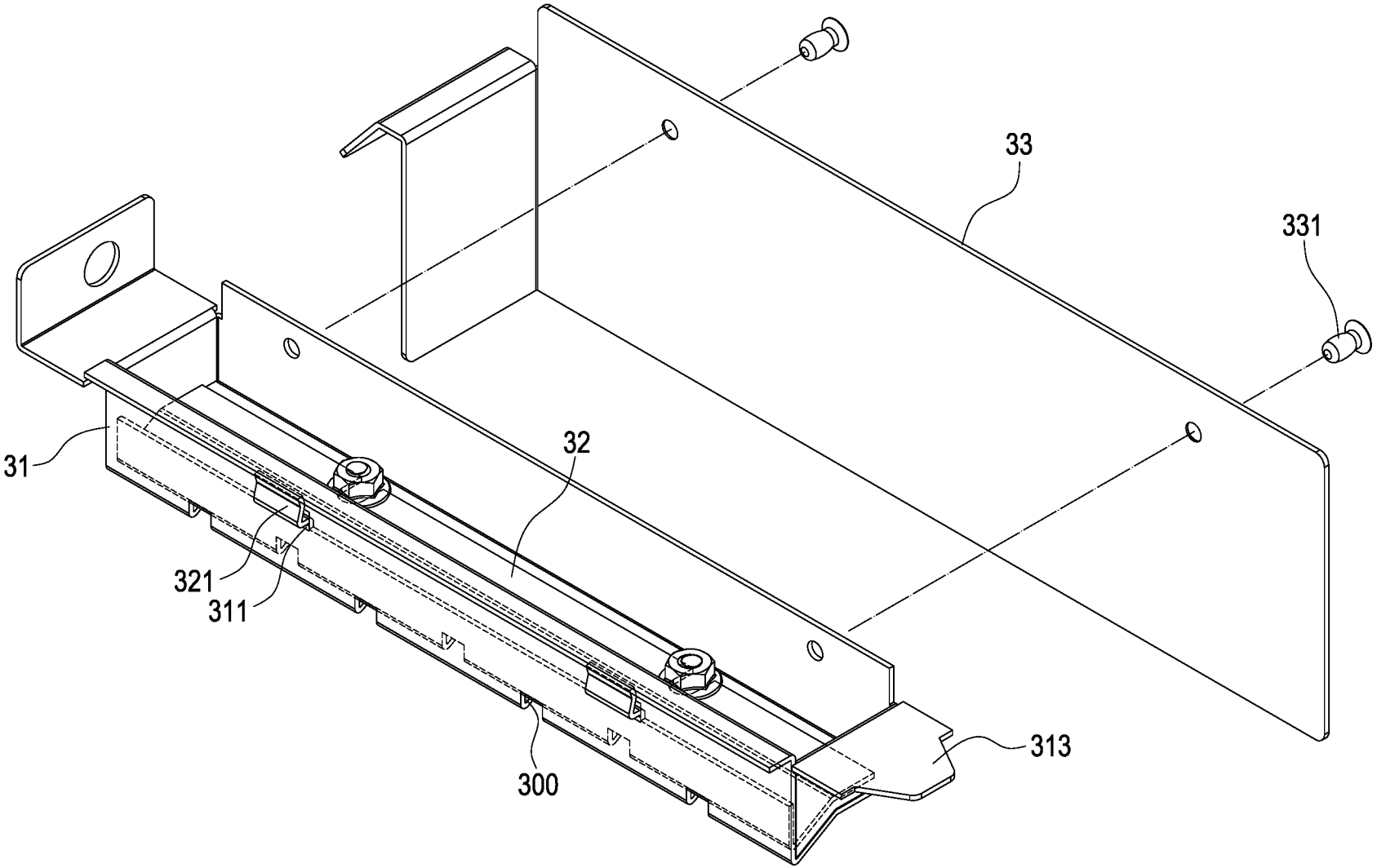
FIG. 8 is a perspective exploded schematic view of the water separator base and the rear baffle in this disclosure.
Figure 9:
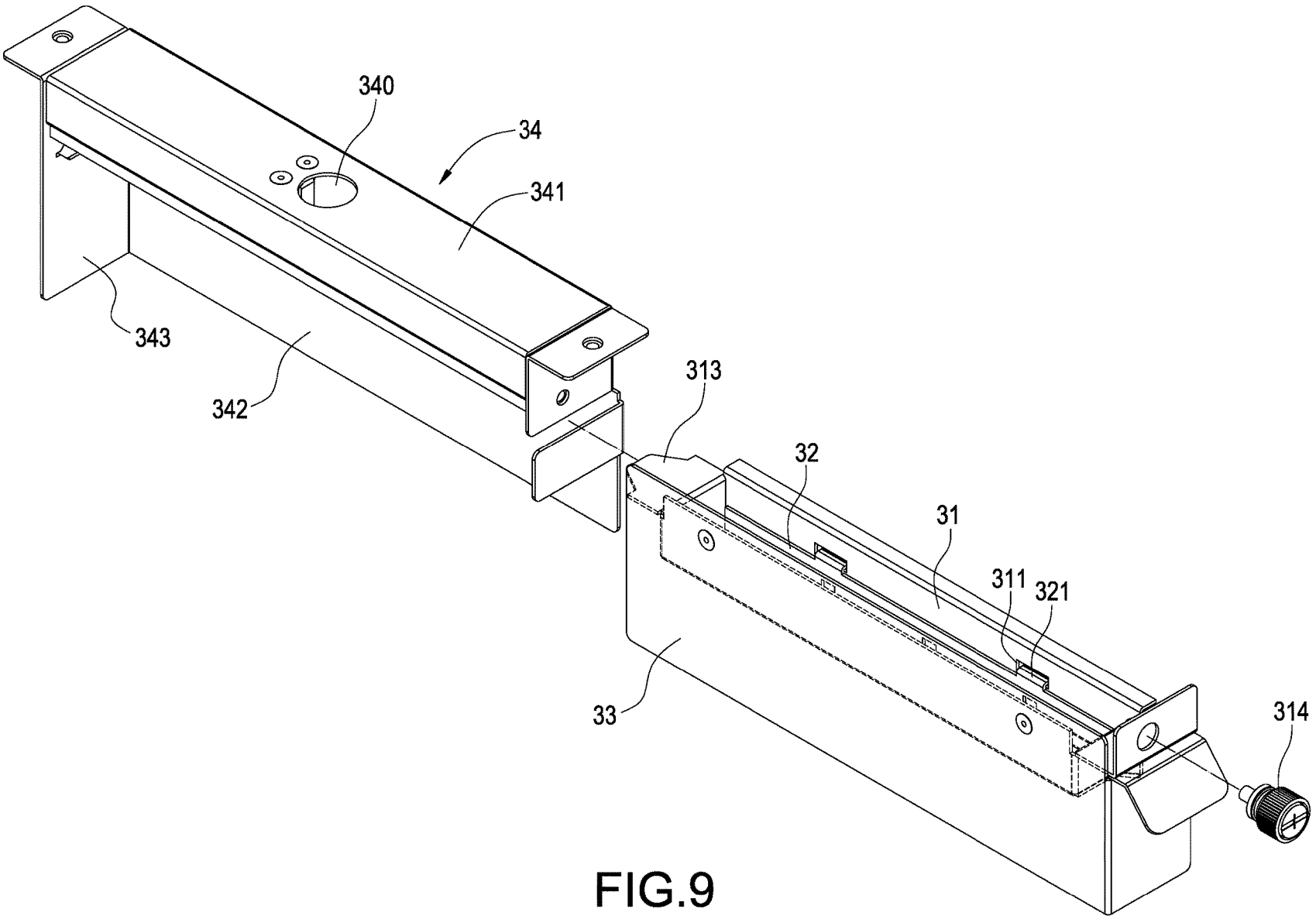
FIG. 9 is a perspective exploded view of the separator lid and the water separator base in this disclosure.

Please further refer to FIG. 7 to FIG. 9, which are a perspective exploded schematic view of the water separator base and the water separator piece in this disclosure, a perspective exploded schematic view of the water separator base and the rear baffle in this disclosure, and a perspective exploded view of the separator lid and the water separator base in this disclosure. In more detail, the water distribution module 30 includes a water separator base 31 and a water separator piece 32. The water separator piece 32 is combined in the water separator base 31 to define a water channel 300. Additionally, the condensate enters the water separator piece 32, and then flows out the water separator base 31 through the water channel 300.

As shown in FIG. 7, a plurality of first diversion holes 320 are arranged spacedly on the water separator piece 32, and the first diversion holes 320 are spaced apart with a space W1. Moreover, a plurality of second diversion holes 310 are arranged spacedly on the water separator base 31, and the second diversion holes 320 are spaced apart with a space W2. The first diversion holes 320 and the second diversion holes 310 are disposed staggeredly and located on two sides of the water channel 300 respectively.

It should be noted that the number of the first water diversion holes 320 and the number of the second water diversion holes 310, as well as the space W1 of the first water diversion holes 320 and the space W2 of the second water diversion holes 310, may be adjusted according to the actual conditions.

Specifically, a plurality of snapping holes 311 are disposed on the water separator base 31, and a plurality of hooks 321 are disposed on the water separator piece 32. The water separator piece 32 is combined in the water separator base 31 through the hooks 321 being engaged with the snapping holes 311.

In this embodiment, the water separator base 31 includes a plurality of lock posts 312, and the water separator piece 32 includes a plurality of slots 322 correspondingly. Thus, the water separator base 31 and the water separator piece 32 are combined through the lock posts 312 being inserted to the slots 322 and are locked by multiple nuts 323.

As shown in FIG. 8, in one embodiment of this disclosure, the water distribution module 30 further includes a rear baffle 33 disposed on a side of the water separator base 31. The rear baffle 33 is coupled to the water separator base 31 on the side away from the fan 60 through multiple locking members 331 (also refer to FIG. 2 and FIG. 3).

In this embodiment, the rear baffle 33 is in an L shape and encloses two sides of the water separator base 31 to be firmly combined with the water separator base 31 for providing a desirable effect of water blocking. It is worth of noticing that the rear baffle 33 is disposed to prevent the condensate from spilling out of the water tank 50 under the airflow of the fans 60 and accumulating at the bottom of the device to cause corrosion of parts. Additionally, the arrangement of the rear baffle 33 may position the multi-folded water absorbing body 40, so that the multi-folded water absorbing body 40 is supported and fixed without inclining or falling sideway in the airflow of the fan 60.

Moreover, the water distribution module 30 further includes a separator lid 34. The water separator base 31 is combined with the separator lid 34 in a detachable manner.

Specifically, as shown in FIG. 9, the separator lid 34 includes an upper cover 341, a front shutter 342 and a side plate 343 connected to one another. A water inlet 340 for inserting a condensate pipe 25 (also refer to FIG. 2 and FIG. 3) is disposed on the upper cover 341. Additionally, the front shutter 342 is located on the side opposite to the rear baffle 33. A latch 313 is extended on one side of the water separator base 31. The water separator base 31 slides into the bottom side of the separator lid 34 and is positioned through the latch 313 being inserted to the side plate 343. Moreover, the water separator base 31 is locked on the separator lid 34 through a stud 314.

On the other hand, when the multi-folded water absorbing body 40 needs to be cleaned, the water separator base 31 is disassembled from the bottom of the separator lid 34 firstly. After removing the locking of the stud 314, the latch 313 is then pulled away from the side plate 343. Accordingly, the water separator base 31 is combined with the separator lid 34 in a detachable manner.

Figure 10:
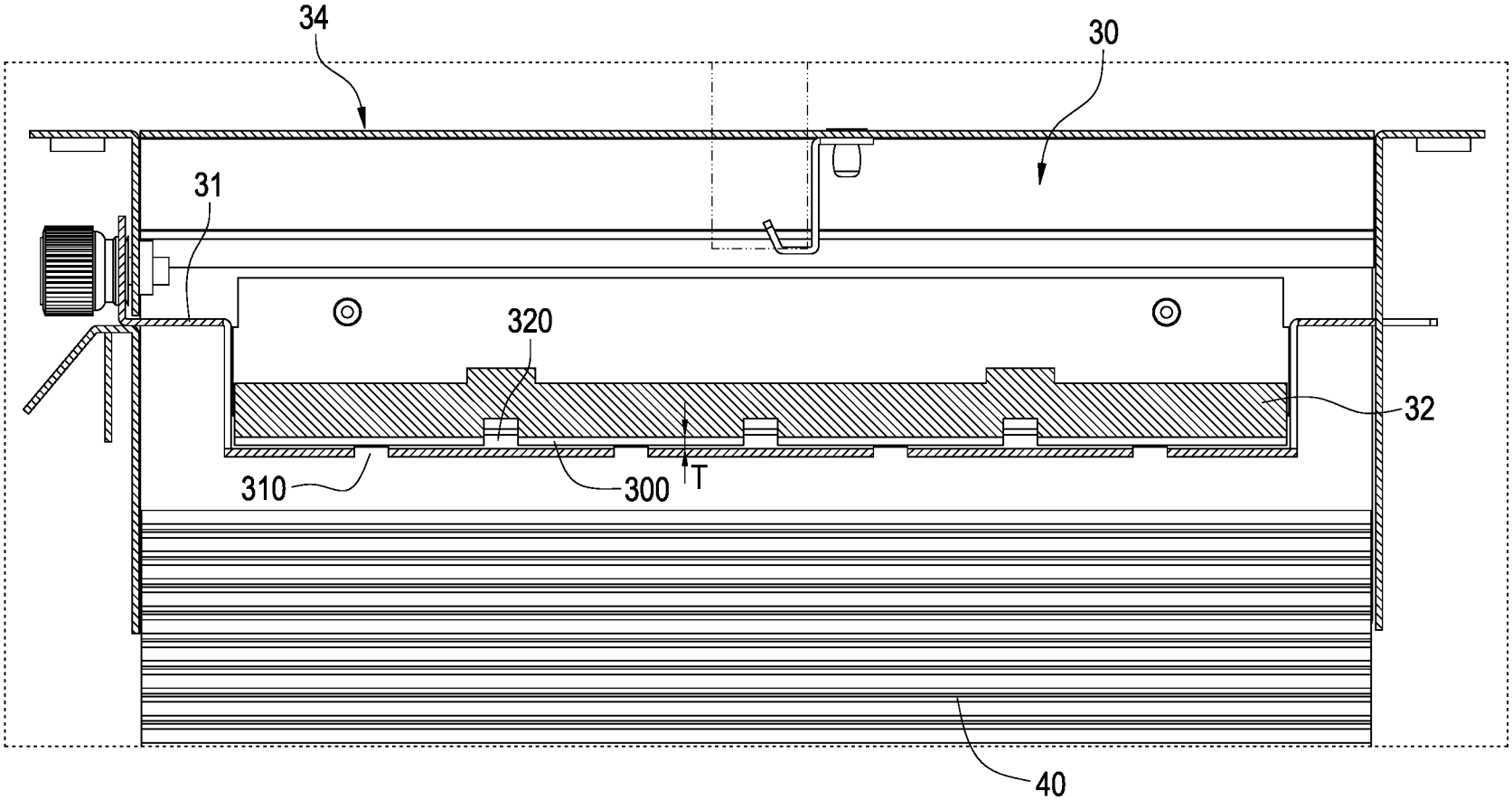
FIG. 10 is a cross-sectional view of one side of the assembly of the water separator base and the multi-folded water absorbing body in this disclosure.
Figure 11:
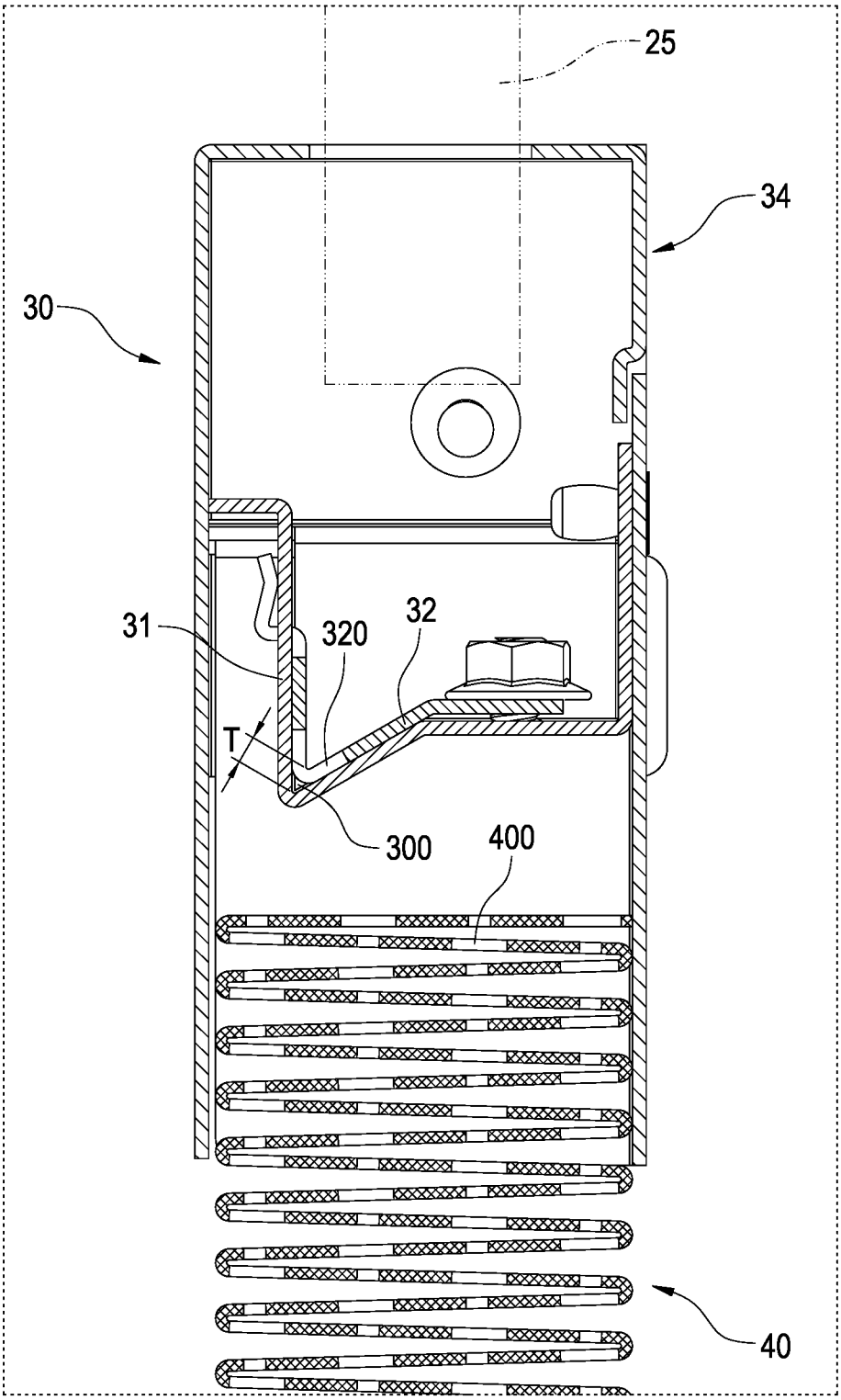
FIG. 11 and FIG. 12 are cross-sectional views of another side of the assembly of the water distribution module and the multi-folded water absorbing body at two locations in this disclosure.
Figure 12:
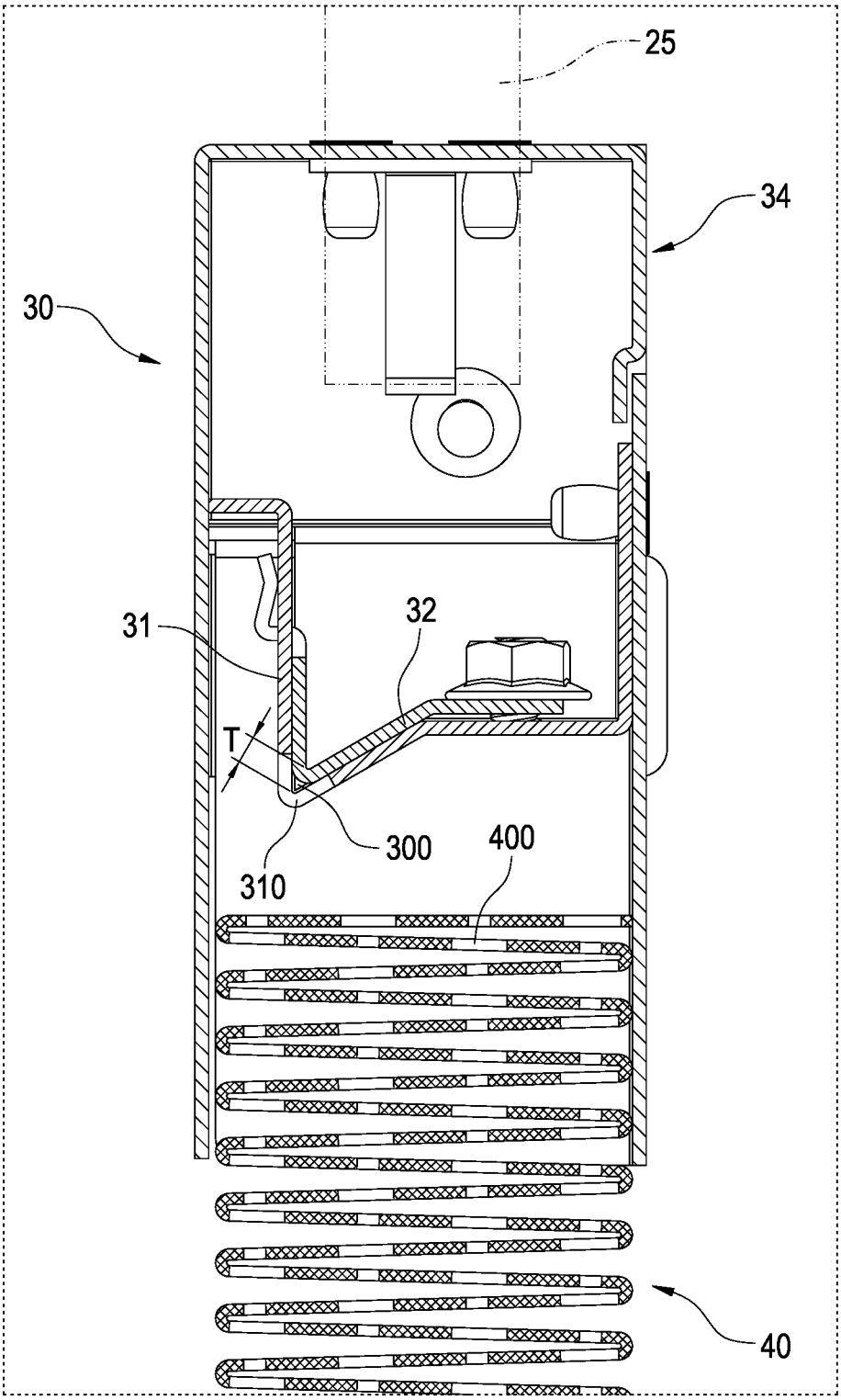

Please refer to FIG. 10 to FIG. 12, which are a cross-sectional view of one side of the assembly of the water separator base and the multi-folded water absorbing body in this disclosure and cross-sectional views of another side of the assembly of the water distribution module and the multi-folded water absorbing body at two locations in this disclosure. As shown in the figures, the separator lid 34 and the rear baffle 33 enclose the top side of the multi-folded water absorbing body 40. The condensate flows into the water distribution module 30 and enters the water channel 300 from the first diversion holes 320 of the water separator piece 32. Then, the condensate enters the second water diversion holes 310 of the water separator base 31 from the water channel 300.

Accordingly, the condensate evenly flows out the water separator base 31 by two-stage water separation through the water distribution module 30. Furthermore, the multi-folded water absorbing body 40 is disposed under the water separator base 31 and evenly absorbs the condensate fell into the multi-folding water-absorbing body 40 from the water separator base 31 to improve the water absorption of the multi-folded water absorbing body 40.

It should be noted that the water channel 300 has a maximum distance T between the water separator piece 32 and the water separator base 31. The maximum distance T may be adjusted according to the actual conditions through the position of the water separator 32 and the water separator base 31 (the distance of the water separator 32 relative to the water separator base 31).

While this disclosure has been described by means of specific embodiments, numerous modifications and variations could be made thereto by those skilled in the art without departing from the scope and spirit of this disclosure set forth in the claims.

What is claimed is:

1. A condensate evaporation device, comprising:

an air conditioning apparatus, comprising a compressor, an evaporator and a condenser connected with one another;

a water tray, arranged on one side of the evaporator to receive a condensate condensed from the evaporator;

a water distribution module, comprising a water separator base and a water separator plate, the water separator plate combined in the water separator base and comprising a water channel, the condensate entering the water separator plate and flowing through the water channel to evenly flow out the water separator base;

a multi-folded water absorbing body, arranged on one side of the water separator base and absorb the condensate flowed out from the water separator base, wherein the multi-folded water absorbing body comprises a plurality of openings in different sizes disposed spacedly thereon, and the multi-folded water absorbing body is repeatedly folded with a same area by the water separator base facing to and stacked under the water separator base;

a water tank, arranged on a bottom side of the multi-folded water absorbing body and receive the condensate flowed out from the multi-folded water absorbing body; and at least one fan, arranged on one side of the multi-folded water absorbing body, wherein the condenser is located between the at least one fan and the multi-folded water absorbing body;

wherein the water separator plate comprises a plurality of first diversion holes arranged spacedly thereon, and the water separator base comprises a plurality of second diversion holes arranged spacedly thereon; and the first diversion holes and the second diversion holes are disposed staggeredly and located on two sides of the water channel respectively, and the condensate flows into the water distribution module and enters the water channel from the first diversion holes of the water separator plate, the condensate enters the second water diversion holes of the water separator base from the water channel.

2. The condensate evaporation device according to claim 1, further comprising: a rear baffle, located on a side of the water separator base away from the at least one fan.

3. The condensate evaporation device according to claim 2, wherein the water distribution module further comprises a separator lid, and the water separator base is detachably combined with the separator lid; and the separator lid and the rear baffle enclose a top side of the multi-folded water absorbing body.

4. The condensate evaporation according to claim 3, wherein the separator lid comprises an upper cover, a front shutter and a side plate connected with one another;

the upper cover comprises a water inlet, and a condensate pipe is inserted in the water inlet;

the front shutter is located on a side opposite to the rear baffle; and the water separator base comprises a latch extended on a side thereof, and the latch is inserted in the side plate.

5. The condensate evaporation device according to claim 1, wherein the air conditioning apparatus further comprises at least one heat pipe;

one end of the heat pipe is connected to the compressor and another end of the heat pipe is connected to the condenser; and a portion of the heat pipe is extended into the water tank.

6. The condensate evaporation device according to claim 1, wherein a maximum distance of the water channel is defined between the water separator plate and the water separator base.

7. The condensate evaporation device according to claim 1, wherein the water separator base comprises a plurality of snapping holes disposed thereon, and the water separator plate comprises a plurality of hooks disposed thereon; and the water separator plate is combined in the water separator base through the hooks being engaged with the snapping holes.

8. The condensate evaporation device according to claim 2, wherein the rear baffle is in an L shape and encloses two sides of the water separator base.

* * * * *